US007469438B2

(12) United States Patent
Li et al.

(10) Patent No.: US 7,469,438 B2
(45) Date of Patent: Dec. 30, 2008

(54) ARCH BRIDGE

(76) Inventors: Yong Li, 13C, Block 13, Caitian Village, Lianhua Road, Futian District, Shenzhen 518036 (CN); Yuzhong Lei, 14D, Caiyunge Mining Building, Caitian North Road, Futian District, Shenzhen 518036 (CN); Yiyan Chen, Side Building, Municipal Design Building, No 3007, West Sungang Road, Shenzhen 518035 (CN)

( * ) Notice: Subject to any disclaimer, the term of this patent is extended or adjusted under 35 U.S.C. 154(b) by 0 days.

(21) Appl. No.: 11/483,503

(22) Filed: Jul. 10, 2006

(65) Prior Publication Data

US 2008/0005857 A1 Jan. 10, 2008

(30) Foreign Application Priority Data

Aug. 29, 2005 (CN) ..... 2005 1 0096976

(51) Int. Cl.
*E01D 4/00* (2006.01)

(52) U.S. Cl. ..... 14/24

(58) Field of Classification Search ..... 14/2, 14/18, 19, 24, 25
See application file for complete search history.

(56) References Cited

U.S. PATENT DOCUMENTS

| | | | | | |
|---|---|---|---|---|---|
| 14,584 | A * | 4/1856 | Huygens | 14/2 |
| 329,249 | A * | 10/1885 | Werner | 14/2 |
| 1,453,084 | A * | 4/1923 | Strauss | 14/19 |
| D194,584 | S * | 2/1963 | Weber | D25/61 |
| 4,055,264 | A * | 10/1977 | Abbott | 414/803 |
| 4,409,762 | A * | 10/1983 | Raymond | 52/9 |
| 4,597,239 | A * | 7/1986 | Matz et al. | 52/644 |
| 4,646,379 | A * | 3/1987 | Muller | 14/23 |
| 4,691,399 | A * | 9/1987 | Kim et al. | 14/2 |
| 4,831,792 | A * | 5/1989 | Berger | 52/66 |
| 5,070,566 | A * | 12/1991 | Lin et al. | 14/19 |
| 5,325,557 | A * | 7/1994 | Penuela | 14/8 |
| 5,867,948 | A * | 2/1999 | Liu | 52/80.1 |
| 6,401,285 | B1 * | 6/2002 | Morris | 14/19 |
| 6,530,101 | B1 * | 3/2003 | Nottingham | 14/20 |
| 7,062,812 | B1 * | 6/2006 | Morris | 14/18 |
| 7,066,094 | B2 * | 6/2006 | Moutsokapas et al. | 104/124 |
| 7,146,672 | B1 * | 12/2006 | Meheen | 14/2 |
| 2004/0182025 | A1 * | 9/2004 | Moutsokapas et al. | 52/299 |
| 2006/0117504 | A1 * | 6/2006 | Ronald et al. | 14/73 |

OTHER PUBLICATIONS

"References" website, http://web.archive.org/web/20050105025629/http://www.klein-engineering.ch/bridgelab/ref/references.html (Jan. 5, 2005); Arch Bridges 1, Sheikh Zayed Bridge, Abu Dhabi, United Arab Emirates, designed by Zaha Hadid.*

* cited by examiner

*Primary Examiner*—Raymond W Addie

(57) ABSTRACT

An exemplary bridge includes an arch unit. The arch unit includes a first abutment and a second abutment, a deck extending between the first and second abutments, a pair of asymmetrical arches, and a plurality of suspender members 3 attached between the arches and the deck. The first and second abutments are spaced apart from each other at a predetermined distance. The asymmetrical arches are juxtaposedly arranged between and supported by the first and second abutments. Each of the asymmetrical arches includes a first arch foot portion mounted on the first abutment, a parabolic portion proximate to the first arch foot portion, a catenary portion proximate to the parabolic portion, and a second arch foot portion proximate to the catenary portion mounted on the second abutment.

2 Claims, 15 Drawing Sheets

ARCH BRIDGE

BACKGROUND

1. Field of the Invention

The present invention relates to bridges, and particularly to a long span arch bridge having an asymmetrical arch with improved mechanical strength characteristics.

2. Description of Related Art

U.S. Pat. No. 5,070,566 discloses an arch bridge. The arch bridge comprises a set of arches, each extending longitudinally along the bridge. The arch bridge includes at least one central arch and at least two side arches, symmetrically disposed about the central arch. The side arches are slanted transversely inwardly so that they are closest at the longitudinal center of the bridge and are generally disposed either above or below the central arch. In addition, transverse members connect the arches together and a deck is suspended from the set of arches.

SUMMARY

In one aspect of the present invention, a bridge having an arch unit is provided. The arch unit includes a first abutment and a second abutment, a deck extending between the first and second abutments, a pair of asymmetrical arches, and a plurality of suspender members attached between the arches and the deck. The first and second abutments are spaced apart from each other at a predetermined distance. The asymmetrical arches are juxtaposedly arranged between and supported by the first and second abutments. Each of the asymmetrical arches includes a first arch foot portion mounted on the first abutment, a parabolic portion proximate to the first arch foot portion, a catenary portion proximate to the parabolic portion, and a second arch foot portion proximate to the catenary portion mounted on the second abutment.

In another aspect of the present invention, a bridge having a plurality of arch units is provided. Each arch unit includes a first abutment and a second abutment, a deck extending between the first and second abutments, a pair of asymmetrical arches, and a plurality of suspender members attached between the arches and the deck. The first and second abutments are spaced apart from each other at a predetermined distance. The asymmetrical arches are juxtaposedly arranged between and supported by the first and second abutments. Each of the asymmetrical arches includes a first arch foot portion mounted on the first abutment, a parabolic portion proximate to the first arch foot portion, a catenary portion proximate to the parabolic portion, and a second arch foot portion proximate to the catenary portion mounted on the second abutment.

In still another aspect of the present invention, a bridge having two arch units is provided. Each arch unit includes a first abutment and a second abutment, a deck extending between the first and second abutments, a pair of asymmetrical arches, and a plurality of suspender members attached between the arches and the deck. The first and second abutments are spaced apart from each other at a predetermined distance. The asymmetrical arches are juxtaposedly arranged between and supported by the first and second abutments. Each of the asymmetrical arches includes a first arch foot portion mounted on the first abutment, a parabolic portion proximate to the first arch foot portion, a catenary portion proximate to the parabolic portion, and a second arch foot portion proximate to the catenary portion mounted on the second abutment. The arch units may be arranged in a manner such that the second arch foot portions thereof are adjacent to each other.

The above and other features of the invention, including various novel details of construction and combination of parts, will now be more particularly described with reference to the accompanying drawings, in which:

DETAILED DESCRIPTION OF PREFERRED EMBODIMENTS

Reference will now be made to the drawings to describe the present invention in detail.

Figure 1:
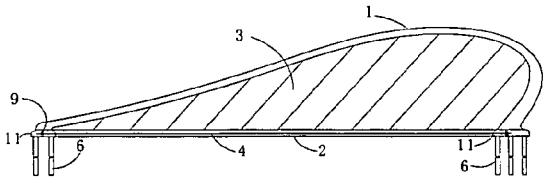
FIG. 1 is a schematic, front view of a bridge in accordance with a first preferred embodiment of the present invention.
Figure 2:
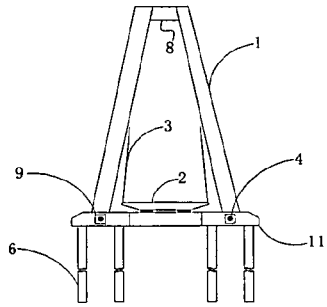
FIG. 2 is a schematic, side view of the bridge of FIG. 1.

Referring to FIGS. 1 and 2, a bridge in accordance with a first embodiment of the present invention is provided. The bridge has a single arch unit. The arch unit includes a first abutment and a second abutment, a deck 2 extending between the first and second abutments, a pair of asymmetrical arches 1, and a plurality of suspender members 3 attached between the arches 1 and the deck 2.

Figure 3:
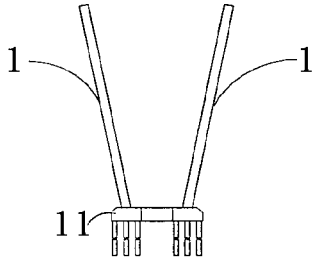
FIG. 3 is a schematic, side view of an alternative arrangement of asymmetrical arches of FIG. 2.
Figure 4:
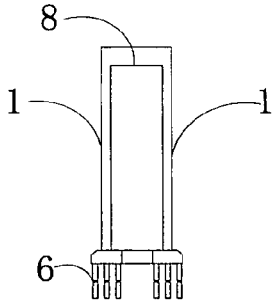
FIG. 4 is a schematic, side view of another alternative arrangement of the asymmetrical arches of FIG. 2.
Figure 5:
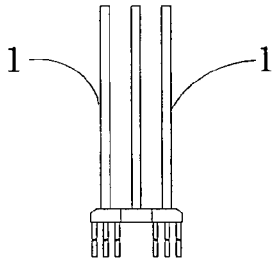
FIG. 5 is a schematic, side view of still another alternative arrangement of the asymmetrical arches of FIG. 2.

The first and second abutments are spaced apart from each other at a predetermined distance. The asymmetrical arches 1 are juxtaposedly arranged between and supported by the first and second abutments. The arch unit may further include a plurality of transverse bracings 8 attached between the asymmetrical arches 1 and the deck 2. The asymmetrical arches are slanted inwardly thereby defining an angle of less than 30 degrees therebetween. Referring to FIG. 3, the asymmetrical arches could be slanted outwardly thereby defining an angle of less than 30 degrees therebetween. Referring to FIG. 4, the asymmetrical arches 1 could alternatively be oriented perpendicular to the deck 2. Referring to FIG. 5, in the case of vertically-oriented asymmetrical arches 1, the number of the asymmetrical arches 1 could be more than 2, for example, 3 as in shown in FIG. 5, and should be considered within the scope of the present invention.

Figure 6:
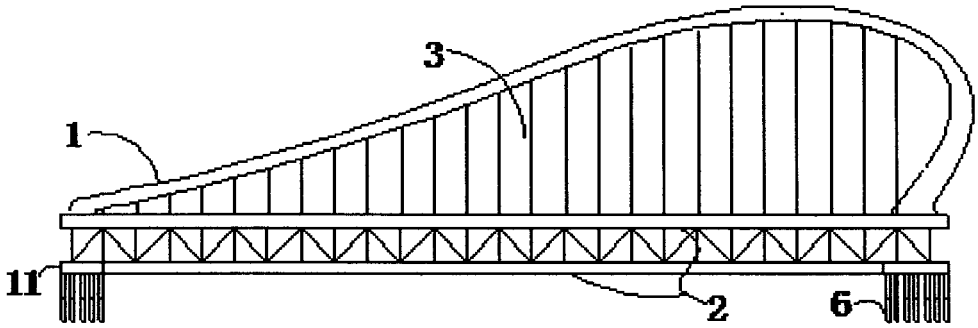
FIG. 6 is a schematic, side view of an alternative horizontal beam of FIG. 1.
Figure 7:
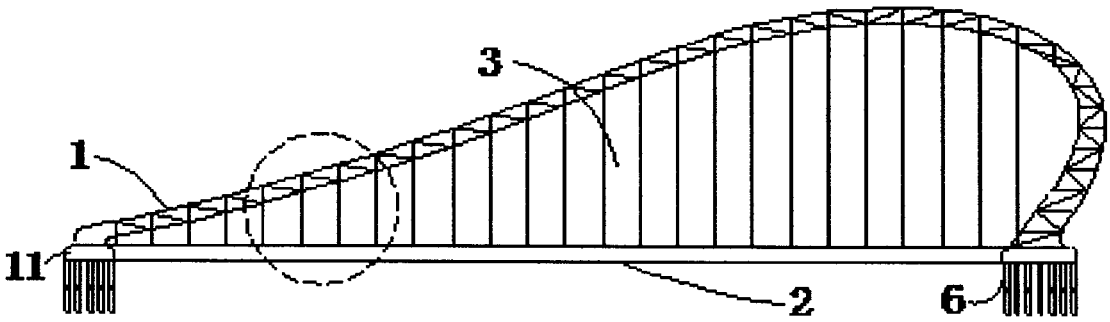
FIG. 7 is a schematic, side view of an alternative arch of FIG. 1.
Figure 8:
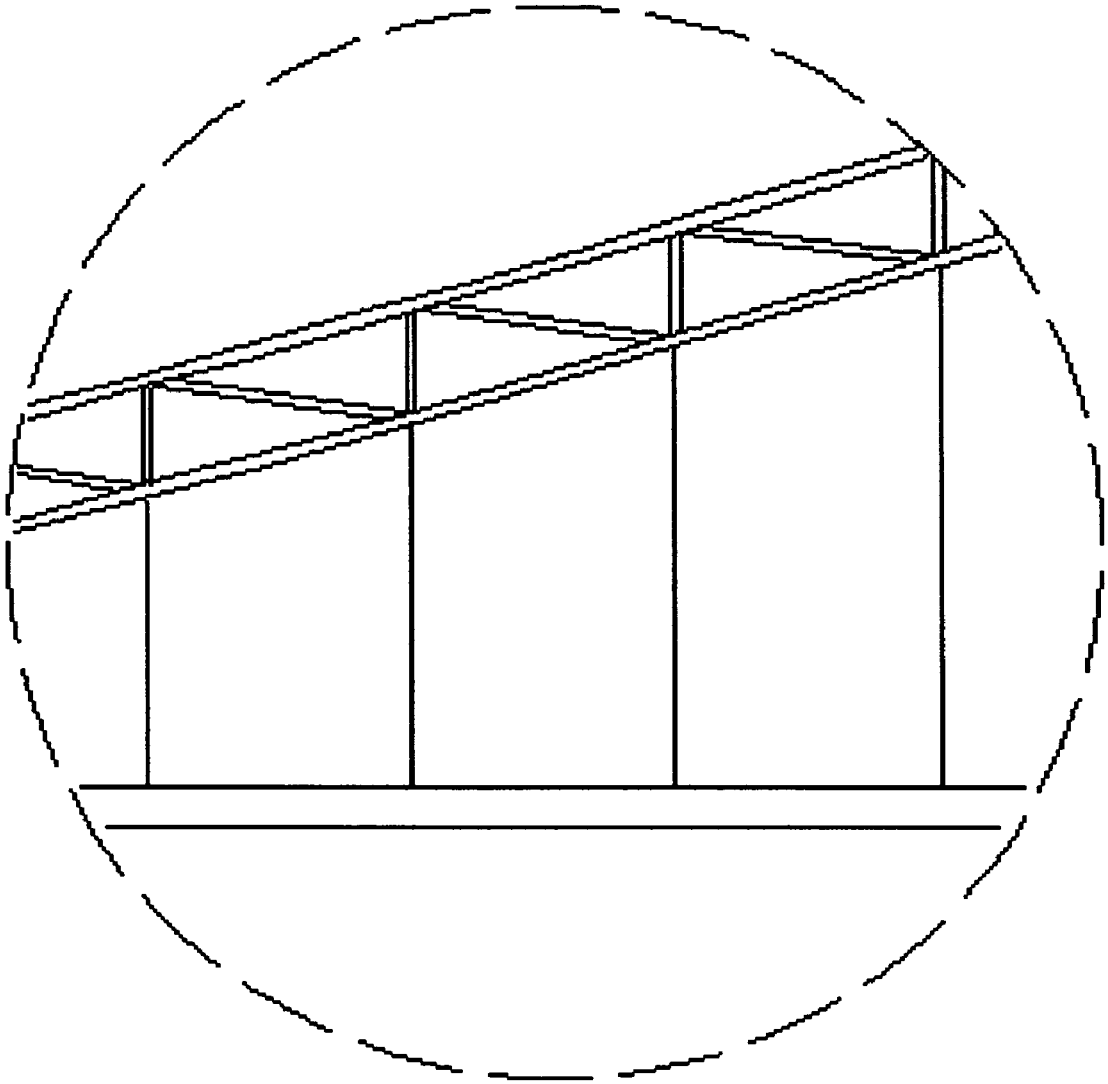
FIG. 8 is a schematic, enlarged view of a circled portion of the alternative arch of FIG. 7.

The deck 2 generally comprises at least one horizontal beam extending between the first and second abutments. Referring to FIG. 6, the horizontal beam is generally a truss beam. Similarly, referring to FIG. 7, the asymmetrical arches could be truss arches. FIG. 8 shows an enlarged view of a circled portion of the truss arch of FIG. 7.

Figure 9:
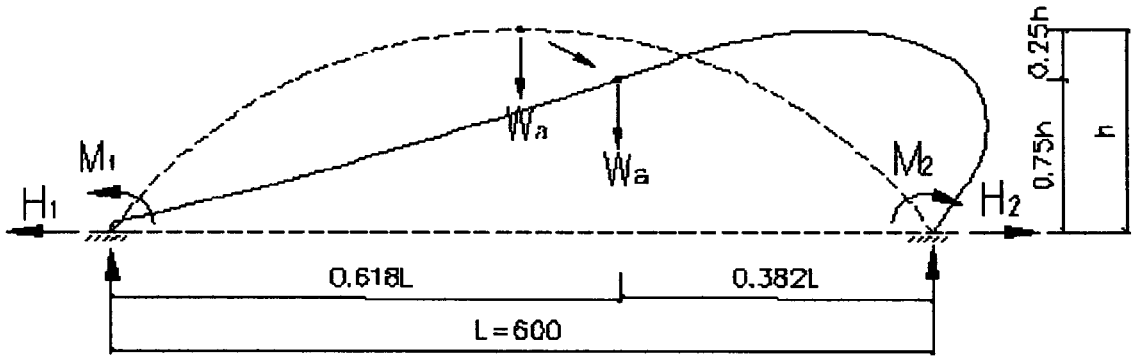
FIG. 9 is a schematic view showing a comparison of the center of gravity between an exemplary configuration of an arch of FIG. 1 and a conventional arch.
Figure 10:
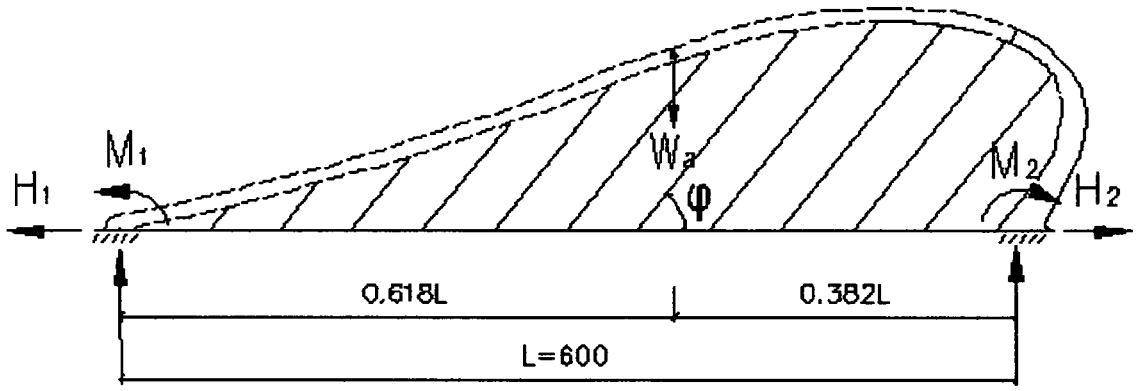
FIG. 10 is a schematic view of an exemplary configuration of an arch of FIG. 1, together with obliquely-oriented suspender members.

Referring to FIGS. 9 and 10, each of the asymmetrical arches 1 includes a first arch foot portion mounted on the first abutment, a parabolic portion proximate to the first arch foot portion, a catenary portion proximate to the parabolic portion, and a second arch foot portion proximate to the catenary portion mounted on the second abutment. The parabolic portion is parabolic arch. The parabolic portion may be defined by a higher-order parabolic equation. The order of the parabolic equation may be in the range from 2 to 8, preferably from 2 to 4. In the illustrated embodiment, the order of the parabolic equation is 2.

Figure 11:
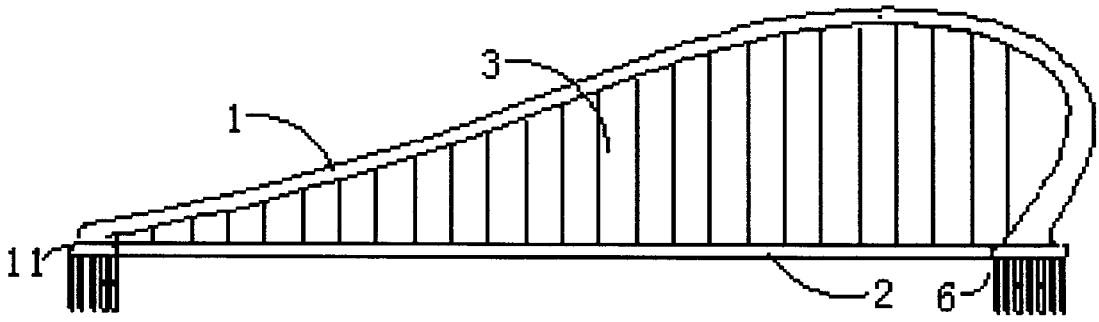
FIG. 11 is similar to FIG. 1, but showing an alternative configuration of suspender members of FIG. 1.

In this case, due to the configuration of the parabolic portion of the arch 1, a center of gravity $W_a$ of the arch 1 is decreased to 75% in height, and is moved sidewards 23.6% of the span. This advantageously increases the in-plane stability coefficient of the arch 1 and causes the center of gravity $W_a$ to be close to the boundary constraint condition associated therewith. In addition, horizontal outward thrust $H_2$ of the arch 1 is transferred into bending moment $M_2$ of the parabolic portion of the arch 1, thereby the outward thrust imposed on the first abutment is decreased close to zero. On the other hand, referring to FIG. 10, due to the obliquely-oriented suspender members 3, the outward thrust $H_1$ imposed on the second abutment may be transferred into bending moment $M_1$ and thereby being dramatically decreased. This may minimize the usage of the horizontal tie rods 4 or even eliminate the need of the horizontal tie rods 4 attached between opposite ends of the arch 1. Referring to FIG. 11, the suspender members 3 could alternatively be oriented perpendicularly to the deck 2.

The arch unit generally has a rise-span ratio in the range from ⅙ to ⅓. The arch unit has a span length in the range from 50 meters/164.0 feet to 1000 meters/3280.8 feet. The first and second arch foot portions of each of the asymmetrical arches 1 may be an arc or a line.

Figure 12:
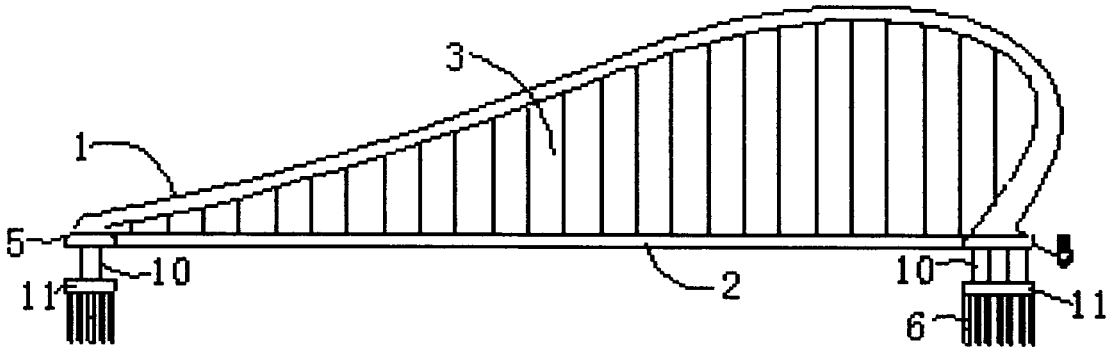
FIG. 12 is similar to FIG. 1, but showing an alternative configuration of first and second abutments of FIG. 1.

Referring to FIG. 12, the first and second abutments each may includes a plurality of piles 6, a bearing platform 11 formed on tops of the piles 6, a pier 10 formed on the bearing platform 11 and a bent cap 5 provided on a top of the pier 10. Referring to FIG. 2, the arch unit may further comprises a first and second bent cap 5 provided on the respective first and second abutments, and a pair of horizontal tie rods 4 with opposite ends thereof being secured to the first and second bent caps 5 by means of anchorage devices 9.

Figure 13:
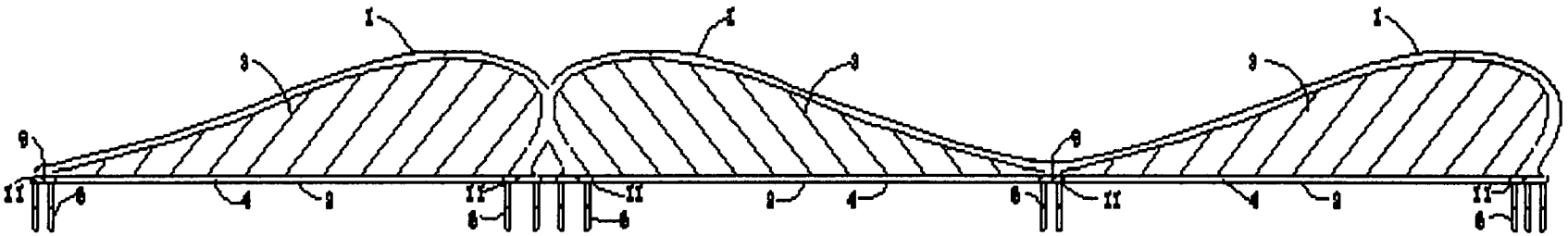
FIG. 13 is a schematic, front view of a bridge in accordance with a second preferred embodiment of the present invention.

Referring to FIG. 13, a bridge in accordance with a second embodiment of the present invention is provided. The bridge has a plurality of arch units, which is similar to the first embodiment of the present invention. At least two adjacent arch units are arranged in a manner such that the first arch foot portions thereof are adjacent to each other, and at least two adjacent arch units are arranged in a manner such that a first arch foot portion thereof is adjacent to a second arch foot portion thereof. Alternatively, at least two adjacent arch units could be spaced apart from each other as shown in FIG. 16, and at least two adjacent arch units could be contiguous to each other as shown in FIGS. 14-15, and 17-19.

Figure 14:
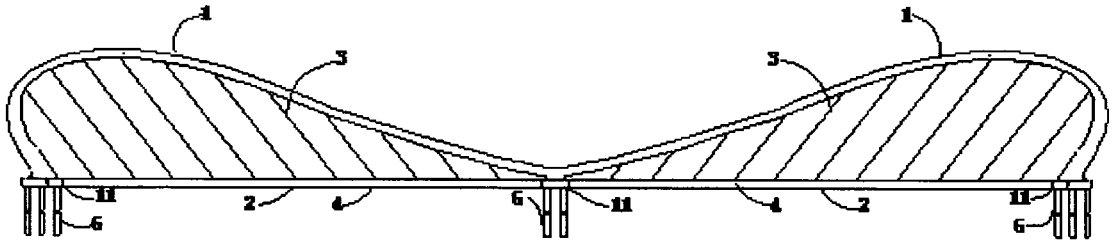
FIGS. 14-19 are schematic views of various alternative configurations of the present bridge.
Figure 15:
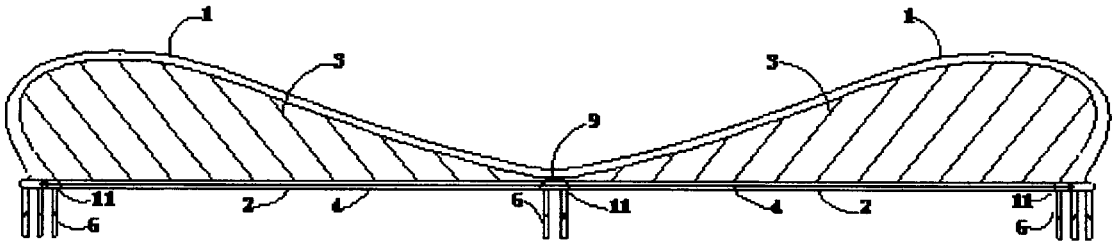
Figure 16:
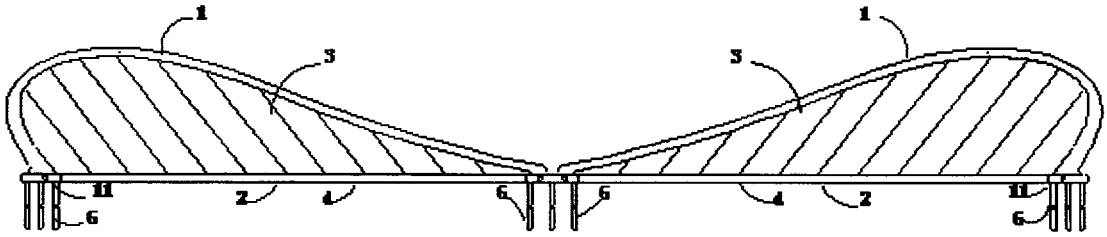
Figure 17:
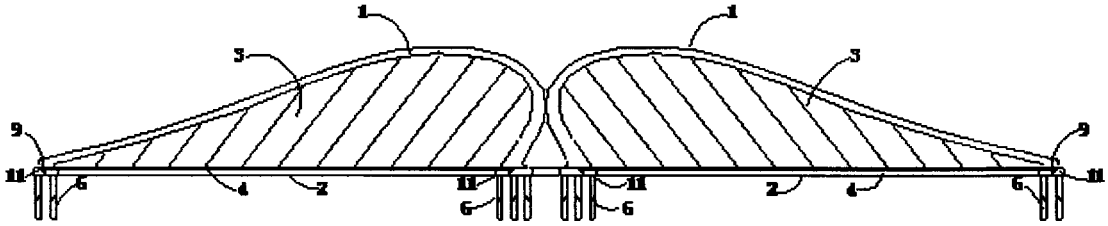
Figure 18:
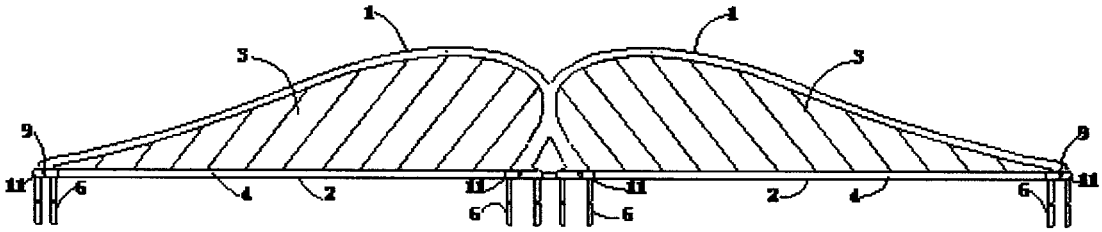
Figure 19:
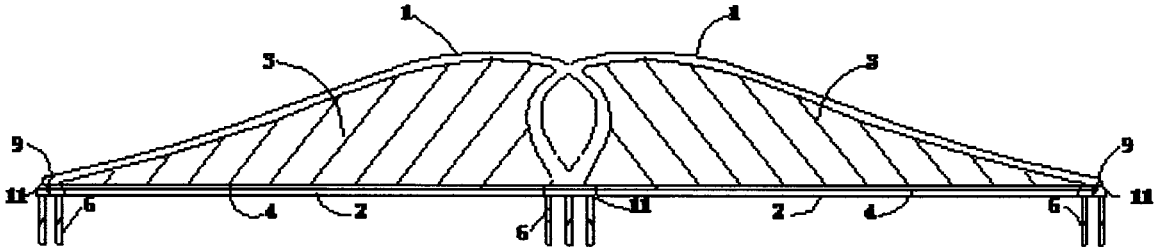

Preferably, referring to FIGS. 14-19, the bridge includes two arch units, which are similar to the first embodiment. More preferably, the arch units are arranged in a manner such that the second arch foot portions thereof are adjacent to each other as shown in FIGS. 14-16.

Although the present invention has been described with reference to a specific embodiment, it should be noted that the described embodiment is not necessarily exclusive and that various changes and modifications may be made to the described embodiment without departing from the scope of the invention as defined by the appended claims.

What is claimed is:

1. An arch bridge comprising an arch unit including:

a first abutment and a second abutment, the first and second abutments being spaced apart from each other at a predetermined distance;

a deck extending between the first and second abutments;

a pair of asymmetrical arches juxtaposedly arranged between and supported by the first and second abutments, wherein each arch has a first end portion and a second end portion, wherein the first end portion of the arch extends upwardly and inclinedly, and the second end portion extends downwardly and inwardly, such that an angle between an inner surface of the second end portion of the arch and the deck is more than 90 degree;

a plurality of suspender members attached between the arches and the deck; and a first and second bent cap provided on the respective first and second abutments, and a pair of horizontal tie rods with opposite ends thereof being secured to the first and second bent caps by means of anchorage devices.

2. An arch bridge comprising an arch unit including:

a first abutment and a second abutment, the first and second abutments being spaced apart from each other at a predetermined distance;

a deck extending between the first and second abutments;

a pair of asymmetrical arches juxtaposedly arranged between and supported by the first and second abutments, wherein the first end portion of the arch extends upwardly and inclinedly, and the second end portion extends downwardly and inwardly, such that an angle between an inner surface of the second end portion of the arch and the deck is more than 90 degree; and a plurality of suspender members attached between the arches and the deck, wherein the first and second abutments each comprises a plurality of piles, a bearing platform formed on tops of the piles, a pier formed on the bearing platform and a bent cap provided on a top of the pier.

* * * * *